US007823227B2

(12) United States Patent
Damianoe et al.

(10) Patent No.: US 7,823,227 B2
(45) Date of Patent: Nov. 2, 2010

(54) BATHROOM ODOR REMOVAL APPARATUS AND SYSTEM

(76) Inventors: Joseph Damianoe, 28 Robenson Ave., Glen Rock, NJ (US) 07452; Joseph Spadola, 354 Shaler Blvd., Ridgefield, NJ (US) 07857; Vladimir Yakhnich, 27 Clifford Dr., Park Ridge, NJ (US) 07656

( * ) Notice: Subject to any disclaimer, the term of this patent is extended or adjusted under 35 U.S.C. 154(b) by 1058 days.

(21) Appl. No.: 11/539,967

(22) Filed: Oct. 10, 2006

(65) Prior Publication Data

US 2008/0083056 A1 Apr. 10, 2008

(51) Int. Cl.
*E03D 9/04* (2006.01)

(52) U.S. Cl. ..... 4/213; 4/214

(58) Field of Classification Search ..... 4/213–214
See application file for complete search history.

(56) References Cited

U.S. PATENT DOCUMENTS

| | | | | |
|---|---|---|---|---|
| 3,781,923 | A | 1/1974 | Maisch | |
| 3,927,429 | A | 12/1975 | Pearson | |
| 4,011,608 | A | 3/1977 | Pearson | |
| 4,166,298 | A | 9/1979 | Pearson | |
| 4,583,250 | A | 4/1986 | Valarao | |
| 5,054,130 | A | 10/1991 | Wilson | |
| 5,369,813 | A | 12/1994 | Goddard | |
| 5,394,569 | A | 3/1995 | Poirier | |
| 5,519,899 | A | 5/1996 | Taylor | |
| 5,718,005 | A | 2/1998 | Ng | |
| 6,694,534 | B2 * | 2/2004 | Stone | 4/213 |
| 2005/0015869 | A1 | 1/2005 | Boeckler | |
| 2007/0234469 | A1 * | 10/2007 | Denkewicz et al. | 4/213 |

* cited by examiner

*Primary Examiner*—Gregory L Huson
*Assistant Examiner*—Karen Younkins
(74) *Attorney, Agent, or Firm*—Michael A. Blake

(57) ABSTRACT

A bathroom odor removal apparatus comprising: a housing; a filter in the housing; a blower fan located in the housing; a water skirt, with a side opening, and the skirt with an open bottom, and extending from a second end of the housing; a stabilizer adaptor unit attached to the edges of the side opening; clip located on an interior surface of a top wall; a removable conduit attached to the clip; an adapter removeably coupled to a refill tube, to a first end of the removable conduit, and to a top panel; an overflow pipe adapter attached to one end of the conduit; pairs of grooves, with one groove from each pair located on a first side wall, and the second groove from each pair located on a second side wall; and the adjustable stabilizer adaptor attaches to the skirt via any pair of grooves.

2 Claims, 10 Drawing Sheets

BATHROOM ODOR REMOVAL APPARATUS AND SYSTEM

TECHNICAL FIELD

The disclosures made herein relate generally to odor control apparatuses and systems and, more particularly, to bathroom odor control apparatuses.

BACKGROUND

By nature, unpleasant odors are generated in a toilet bowl and have no other way out other than through the top of the toilet bowl due to its gaseous nature. Accordingly, such unpleasant odors adversely impact the air surrounding the toilet and, ultimately, the overall air quality of a bathroom in which the toilet is located. Conventional approaches for controlling odors in bathrooms include scented aerosol dispensers, scented tablets, room ventilation systems and the like.

Such conventional approaches for controlling odors in bathrooms are known to have limitations that adversely affect their effectiveness and/or practicality. One limitation is that unpleasant odors that originate in an area of a particular toilet bowl are allowed to migrate into or are drawn into other areas of a bathroom, thus adversely impacting the overall air quality of the bathroom. Another limitation is that some people dislike or are allergic to perfumed scents of aerosol sprays and tablets commonly used to cover-up unpleasant odors in bathrooms. Still another limitation is that some bathrooms are not physically situated or constructed in a manner where a window or fan can be provided for facilitating ventilation of such bathrooms. Many bathrooms are equipped with a ceiling vent that is meant to draw odors out of the bathroom. However, this solution for controlling odor is frequently inadequate because very large volumes of room air must be exhausted in order to dissipate odors that are actually concentrated in and about the toilet bowl.

Therefore, a bathroom odor control apparatus and system that overcomes limitations associated with such conventional bathroom odor control devices would be useful and novel.

SUMMARY

The disclosed invention relates to a bathroom odor removal system comprising: a toilet bowl; a toilet seat located adjacent to the toilet bowl; flush holes located in the toilet bowl; a fluid channel located in the toilet bowl and in fluid communication with the flush holes; a flush valve in fluid communication with the fluid channel, the flush valve comprising a flapper and an overflow pipe conduit; an overflow pipe in fluid communication with the overflow pipe conduit; a toilet tank in fluid communication with the flapper and the overflow pipe conduit; a toilet tank lid attached to the top of the toilet tank via a seal that provides for a generally air tight seal between the toilet tank and the toilet tank lid; a lid conduit located within the toilet tank lid; at least one air opening located in the toilet tank lid and in fluid communication with the lid conduit; a make up air tube, with an outlet, in fluid communication with the lid conduit and the interior of the toilet tank, where the outlet is configured to be between about ½ inch to about 1-½ inches below the water level of the toilet tank when the toilet tank is full; a blower fan located within the toilet tank above the water level of the toilet tank when the toilet tank is full: an air filter located adjacent to the blower fan and configured to filter the air exiting the blower fan; an exhaust tube in fluid communication with the air filter and the lid conduit; and where the blower fan is configured to pull air from the toilet bowl, through the flush holes, through the fluid channel, through the overflow pipe conduit; through the overflow pipe, into the blower, out the blower into the air filter, into the exhaust pipe, into the lid conduit, and out the at least one air opening.

The disclosed invention also relates to a bathroom odor removal apparatus comprising: a housing with a first end and a second end; a filter located on a first end of the housing; a blower fan located in the housing adjacent to the filter; a water skirt, with an open bottom, extending from the second end of the housing; a stabilizer tube located within the water skirt, the stabilizer tube with an open tube inlet end, and an open tube outlet end; an adapter locating in the housing; an inner conduit with an conduit outlet end and a conduit inlet end, the conduit inlet end attached to the adapter, the conduit outlet end in fluid communication with the inlet end of the stabilizer tube; a refill tube attachable to the adapter, the refill tube configurable to be in fluid communication with the inner conduit.

In addition, the disclosed invention relates to a bathroom odor removal apparatus comprising: a housing with a first end and a second end; a filter located on a first end of the housing; a blower fan located in the housing adjacent to the filter; a water skirt, with an outer surface and with an open bottom, the water skirt extending from the second end of the housing; a standard stabilizer adaptor unit removeably attachable to the outer surface of the water skirt, the standard stabilizer tube with a closed tube inlet end, and an open tube outlet end, the standard stabilizer adaptor unit with a height hS; an extended stabilizer adaptor unit removeably attachable to the outer surface of the water skirt, the extended standard stabilizer tube with a closed tube inlet end, and an open tube outlet end, the extended stabilizer tube with a height hE; a first adapter located on the tube inlet end of the standard stabilizer tube, the first adapter in fluid communication with the standard stabilizer tube; a second adapter located on the tube inlet end of the extended stabilizer tube, the second adapter in fluid communication with the extended stabilizer tube; a refill tube removeably attachable to both the first adapter and the second adapter; and where hE is larger than hS.

Further, the disclosed invention relates to a bathroom odor removal apparatus comprising: a housing with a first end and a second end; a filter located on a first end of the housing; a blower fan located in the housing adjacent to the filter; a water skirt, with a side opening, the side opening with a first opening edge and second opening edge, and the water skirt with an open bottom, the water skirt extending from the second end of the housing; an adjustable stabilizer adaptor unit removeably attachable to the first opening edge and second opening edge, the adjustable stabilizer adapter unit having a top wall, a rear wall, first a side wall, and a second side wall, a removable rear panel located on the rear wall; a removable top panel located on the top wall; at least one clip located on an interior surface of the top wall; a removable conduit configured to attach to the at least one clip; an adapter configured to removeably couple to a refill tube, to a first end of the removable conduit; and to the top panel; an overflow pipe adapter configured to attach to one end of the conduit; a plurality of pairs of grooves, with one groove from each pair located generally on the first side wall, and the second groove from each pair located generally on the second side wall; and where the adjustable stabilizer adaptor unit can be attached to the water skirt via any pair of grooves.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
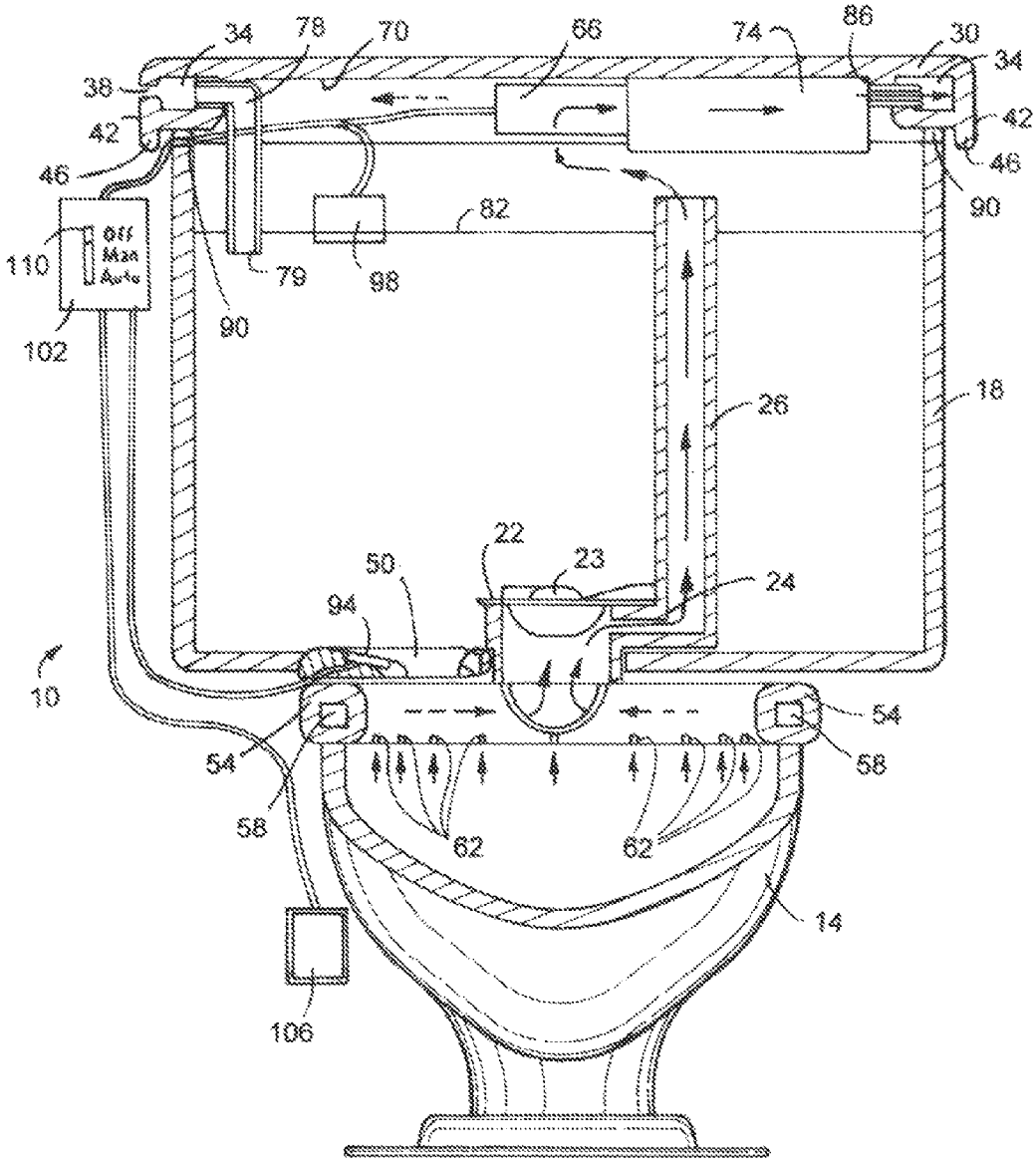
FIG. 1 is a schematic diagram of the disclosed bathroom odor removal system.

FIG. 1 is a schematic diagram of a bathroom odor removal system 10. A toilet bowl 14 is in fluid communication with a toilet tank 18. A toilet flush valve 22 is located between the toilet bowl 14 and toilet tank 18. An overflow pipe 26 is in fluid communication with the toilet flush valve 22. A toilet tank lid 30 covers the toilet tank 18. Known prior art toilet tank lids 30 typically have a lid conduit 34 that runs within the lid 30, often around a periphery of the lid 30. Standard lids 30 can be modified for use in the disclosed invention by making three to twenty lid air openings 38. The openings 38 may be plurality of holes, preferably between 2 and 7 holes of various sizes, through the outer surface 42 of the lid lip 46 so that the air outside of the tank 18 will be in fluid communication with the air inside the conduit 34. If the lid is made out of vitreous china, the holes may be drilled using diamond drills. In other embodiments, the lids 30 may be manufactured specifically for use with the system, with the lid air openings 38 already located in the lid 30. Attached to the toilet bowl 14 is the toilet seat 50 (only shown partially for simplification). The toilet bowl 14 comprises a toilet bowl rim 54. The toilet bowl rim 54 has a fluid channel 58 that is in communication with flush valve 22. Located generally along a periphery of the toilet bowl rim 54 are flush water holes 62. The flush valve comprises a flapper 23 and an overflow pipe conduit 24 to the overflow pipe 26. As typical with most toilets, water can flow into the toilet bowl via two paths, the first path is through the flapper 23, then to the fluid channel 58, then through the flush holes 62 into the toilet bowl 14. The second path is through the overflow pipe 26, through the overflow pipe conduit 24, then into the fluid channel 58, then through the flush holes 62 into the toilet bowl 14. Water is supplied to the tank and to the overflow pipe 26 from a refill valve (not shown) that supplies fresh water to the toilet. Located within the tank 18 is an air filter 74 housing. The air filter housing 74 may house any suitable filtering means for generally removing bathroom odors, such as but not limited to an activated carbon media. In one embodiment, the air filter housing 74 may be attached to the lower surface 70 of the tank lid 30. Also located within the tank 18 is a blower fan 66. The blower fan 66 may be capable of moving about 1 to about 2 CFM given the static pressure of the system. The blower fan 66 may be adjustable to compensate for special conditions and system losses, air flow resistance, and sound level and performance. In one embodiment, the blower fan may be attached to the air filter 74. An exhaust tube 86 is in fluid communication with the filtering means and the lid conduit 34 in the lid 30. A make up air tube 78 is attached to the lid 30 and is in fluid communication with the lid air openings 38. When the tank 18 is full, the water level is at the water level line 82. There is also a seal 90 located between the tank 18 and lid 30. The seal extends about the perimeter of the top of the tank 18, and creates a generally airtight seal between the tank lid 30 and tank 18. Standard tanks and lids are expected to leak air and are part of the venting of a toilet. Thus the task of sealing the surfaces between the tank 18 and the lid 30 is important. Material for the seal 90 may be any suitable resilient seal material or materials. One suitable sealing means, includes, but is not limited to: a combination of Frost King, Poly Foam, #L342, applied to the lid 30 in combination with Frost King, Poly Foam, #L341 applied to the tank 18. Additionally, there is a flush sensor 98 located in the tank 18. The flush sensor 98 is configured to detect a drop in water level in the tank 18. The flush sensor 98 is in communication with the blower fan 66. When a flush is detected, i.e. the water level drops in the tank 18, the flush sensor sends a signal to the blower fan 66. Upon receipt of the signal, the blower fan 66 shuts off for a predetermined time to allow the flush to complete. This is necessary because the blower fan 66 and the seal 90 creates a negative pressure in the tank 18. This negative pressure may prevent and/or retard the water from exiting the tank 18 and entering the toilet bowl 14. The make up air tube 78 allows for air to enter the tank 18 when a flush occurs. The make up air tube 78 is normally sealed because the water level line 82 is above the make air tube 78 outlet 79. As soon as the water level line goes below the inlet 79 of the make up air tube 78, the make up air tube 78 is unsealed, and air can enter the tank 18. The outlet 79 is configured to be about ½ inch to about 1-½ inches below the water level of the toilet tank when the toilet tank is full.

In operation, the bathroom odor removal system, works as follows. A person sits on the toilet seat 50, creating a generally enclosed space in the interior of the toilet bowl 14. The blower fan 66 creates a negative pressure in the interior of the tank 18, in the air space generally above the water level line 82. The negative pressures causes air to be pulled from the interior of the bowl 14, through the flush water holes 62, into the fluid channel in the toilet bowl rim 54, to the flush valve 26, through the overflow pipe conduit 24, and up through the overflow pipe 26. The blower fan 66 directs the air so that it travels through the filtering means in the air filter housing 74 where odors are generally removed from the air. The cleaned air leaves the filtering means and enters the one to five exhaust tubes 86, where it enters the lid conduit 34 in the lid 30 and exits via the lid air openings 38, thereby exiting the system and entering the bathroom or other room where the toilet is located. The arrows show generally the pathway of the air through the system 10. In one embodiment the blower fan 66 may be in continuous operation. In an other embodiment, the blower fan may be turned on and off manually by the user. In still another embodiment, the blower fan 66 may be automatically turned on and off based on sensor inputs. This automatically operated blower fan embodiment will be discussed further below.

Still referring to FIG. 1, the bathroom odor removal system 10 may be configured to automatically activate the blower fan 66 when a user sits on the toilet seat 50. A human proximity sensor 94 may be located on the toilet seat 50. The human proximity sensor 94 will be configured to detect when a person sits on the toilet seat 50. The human proximity sensor 94 may be a capacitive sensor. One such sensor is the TS100 TOUCHCELL made by TouchSensor Technologies, LLC, 203 North Gables Boulevard, Wheaton, Ill. 60187. A controller 102 is in communication with the human proximity sensor 94, blower fan 66, and flush sensor 98. The controller 102 may have a Programmable Logic unit or CPU. When the human proximity sensor 94 detects a person sitting on the toilet seat 50, a signal is sent to the controller 102, whereby the controller activates the blower fan 66, and the blower fan begins creating a negative pressure in the toilet tank 18. When the human proximity sensor 94 detects that the person has left the toilet seat 50, a signal is sent to the controller 102, whereupon the controller turns off the blower fan 66. In addition, when a drop in water level is detected by the flush sensor 98, a signal is sent to the controller 102. The controller can then stop the blower fan 66 from operating for a set amount of time, to allow the flush action to complete. The blower fan 66, controller 102, sensor 94, and flush sensor 98 may all be in communication with a power supply 106. The power supply may be external to the toilet, e.g. an electrical outlet, or may be internal to the system, e.g. batteries in the controller 102.

The controller 102 may have an external switch 110. The switch may allow a user to select "Off", "Manual On", and "On Automatic." When turned Off, the system will shut down manually. When turned to Manual On, the blower fan 66 activates. When turned to On Automatic, the blower fan activates when a person sits on the toilet seat 50 and activates the human proximity sensor 94. When the person leaves the toilet seat 50, the human proximity sensor notifies the controller 102, which in turn shuts off the blower fan 66, immediately, or after a pre-set period of time, to allow for any slight residual odor to be removed.

Figure 2:
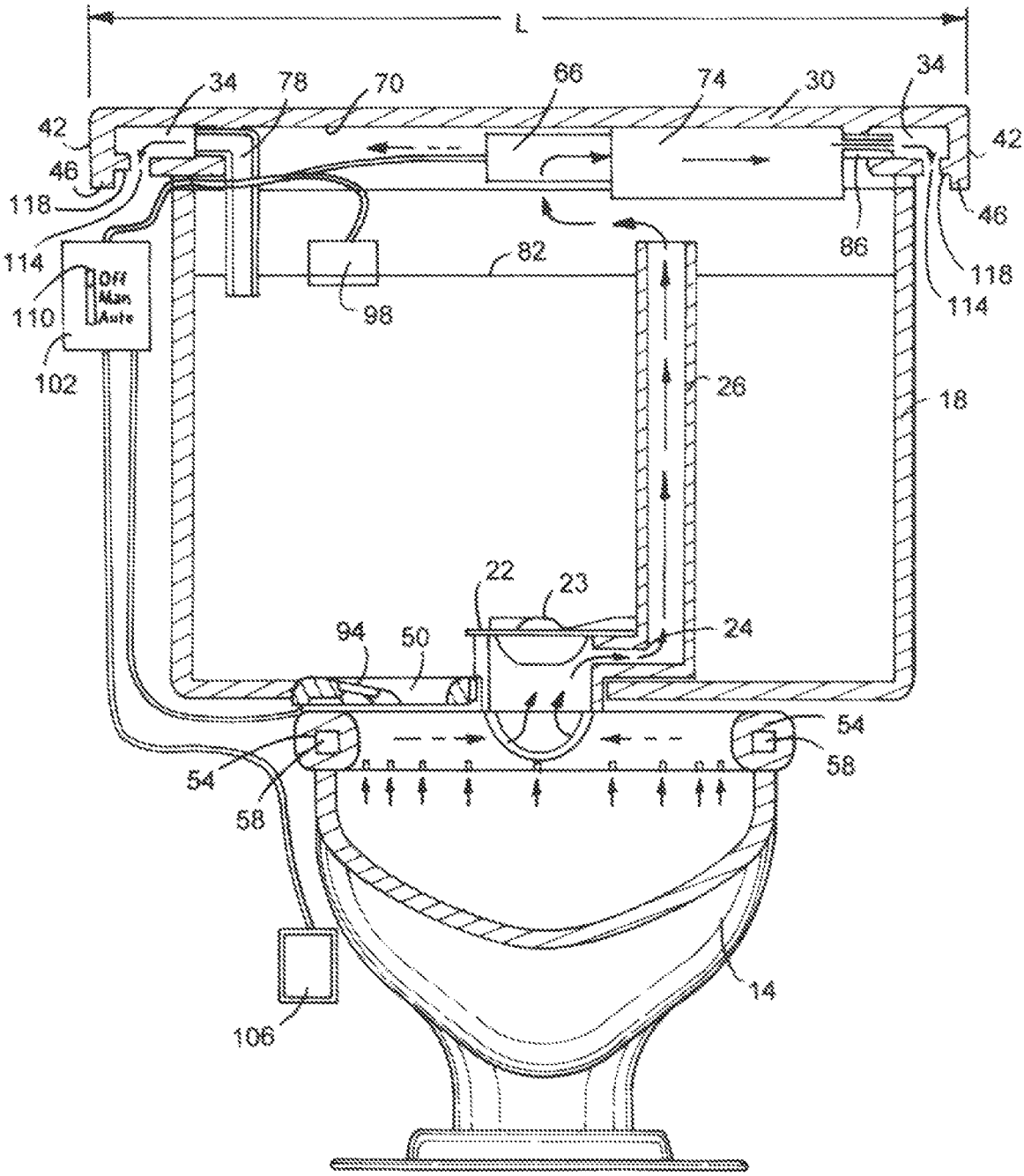
FIG. 2 is a schematic diagram of the disclosed bathroom odor removal system with slots in the toilet tank lid rather than holes.

In other embodiments, where physical layout and construction permit, instead of the lid air openings 38 being located through the outer surface 42 of the lid lip 46, air slots 114 may be made along the underside 118 of the lid 30, as shown in FIG. 2. The air slots 114 may travel transverse to the length L of the lid (i.e. along the width of the lid). The air slots 114 allow fluid communication between the lid conduit 34 and the outside of the tank 18. These air slots 114 would normally be unseen since they are located on the bottom surface 118 of the lid 30, and thereby provided a more aesthetically pleasing appearance.

Figure 3:
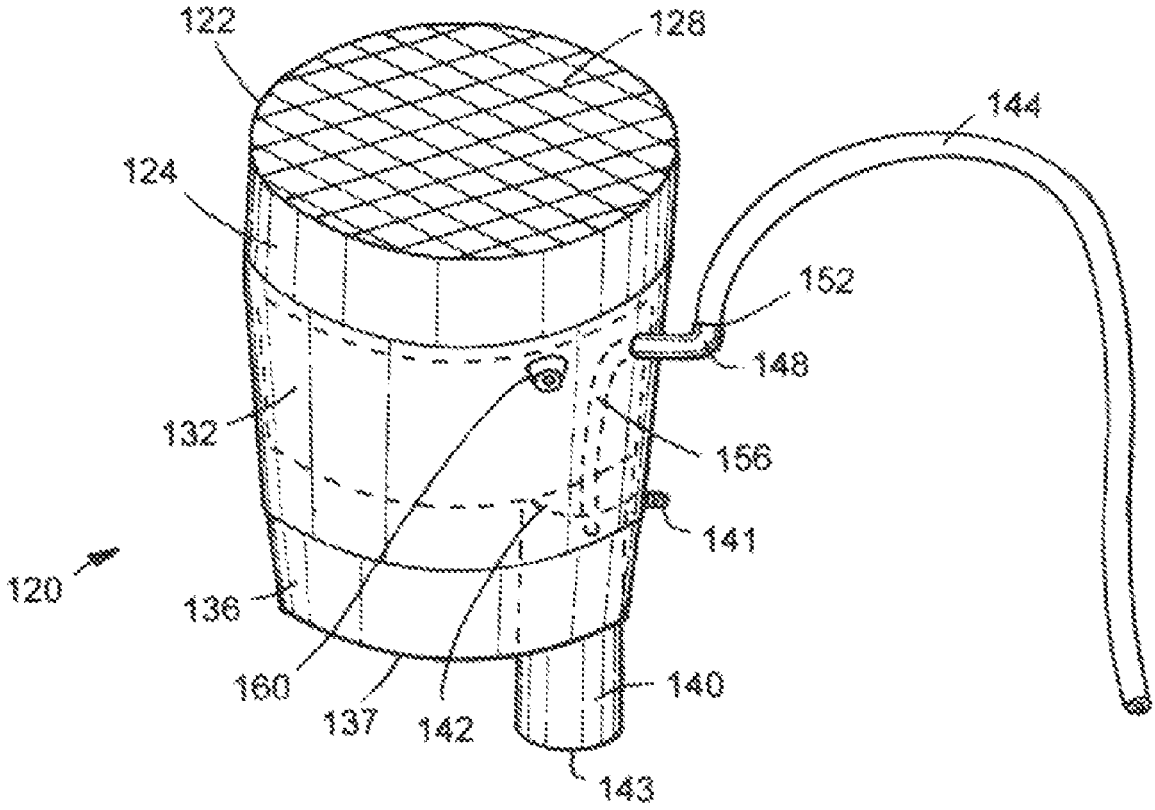
FIG. 3 is perspective view of the disclosed bathroom odor removal apparatus.

FIG. 3 shows another embodiment of the disclosed invention. In this embodiment, the bathroom odor removal system is an odor removal unit 120. The odor removal unit 120 comprises a housing 122. Within the housing is an air filter 124. The housing 122 may have a mesh top 128 adjacent to the air filter 124. Also adjacent to the air filter 124 is a blower fan 132. A water skirt 136 extends from the housing 122. The water skirt 136 is open at its bottom end 137. Extending from the water skirt 136 is a stabilizer tube 140. The stabilizer tube 140 is open at both ends, its inlet end 142 and its outlet end 143 A refill tube 144 connects to the housing 122 via an adapter 148. The adapter 148 is configured so that the refill tube 144 attaches to the adapter 148 on the adapter's upper side 152. The adapter 148 attaches to an inner conduit 156. The inner conduit 156 leads to the stabilizer tube 140, such that any fluid exiting the inner conduit 156 enters the stabilizer tube 140. A power connector 160 allows for the external supply of power to the blower fan 132. However, in other embodiments, the housing 122 may house a power supply such as a battery, or a battery pack. In still other embodiments, a power supply may be adjacent to the odor removal unit 120. A locking screw 141 is configured to screw into the housing 122 and through the stabilizer tube 140. The locking screw 141 is further configured to lock onto the overflow pipe 26, when the stabilizer tube 140 is connected to the overflow pipe 26.

Figure 4:
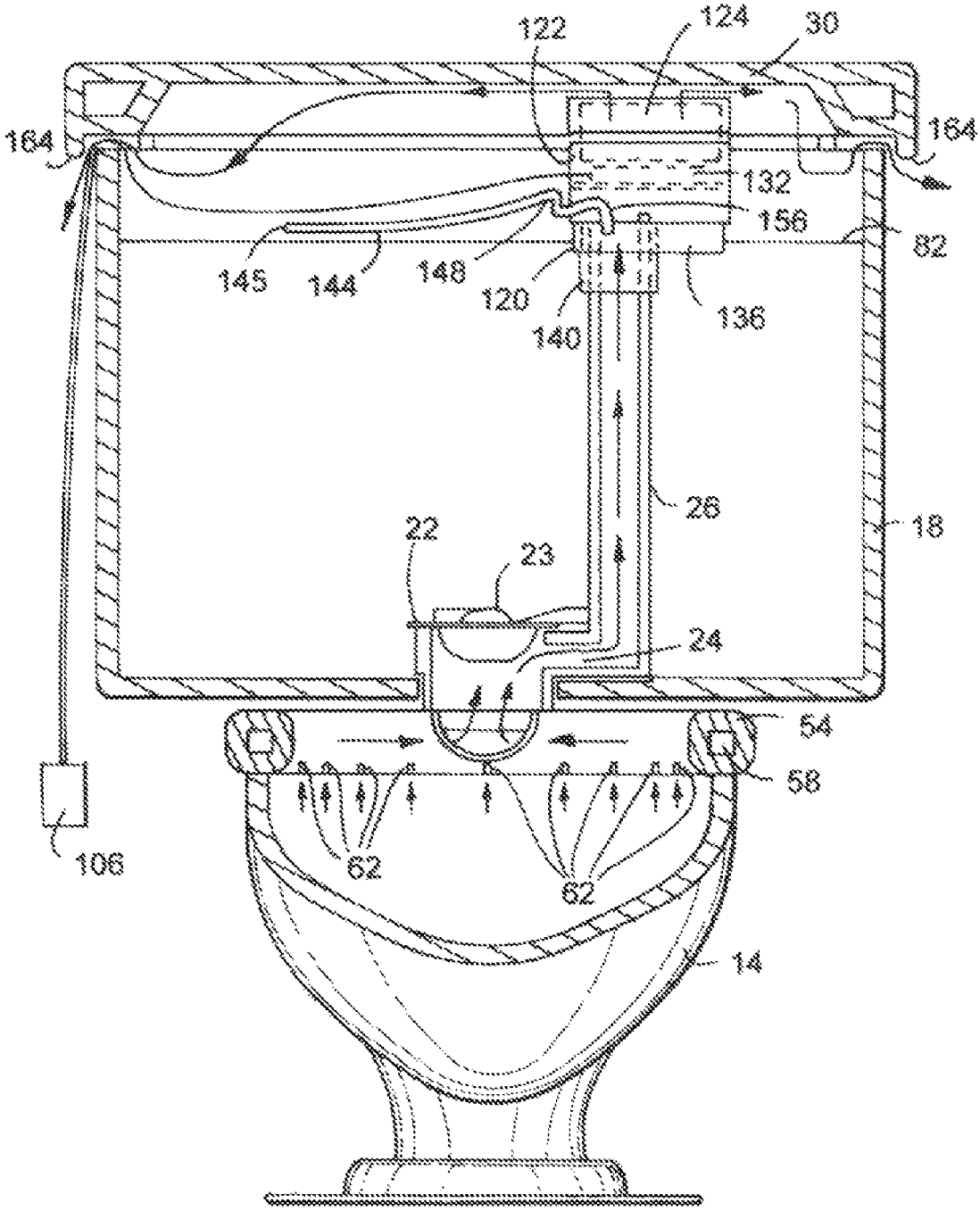
FIG. 4 is a schematic diagram of the disclosed bathroom odor removal apparatus installed in a toilet.

FIG. 4 shows the odor removal unit 120 installed in a toilet tank 18. The stabilizer tube 140 slides over the overflow pipe 26. The refill tube 144 is shown attached to the adapter 148. The free end 145 of the refill tube 144 is not shown connected to the tank fill valve. The tank fill valve is not shown in order to simplify the Figure. However, one of ordinary skill will easily understand that the refill tube 144 connects to the tank fill valve, and provides refill water to the bowl 14 via the inner conduit, and down the overflow pipe. The connection of the refill tube 144 to the refill valve is well known by those of ordinary skill in the art. A power supply 106 is shown external to the toilet and in communication with the odor removal unit 120. However, in other embodiments the external power supply 106 may be replaced by one or more batteries located external to the unit 120. There are no seals in this embodiment between the tank 18 and the tank lid 30. Thus air can leave the tank and enter the tank via gaps 164 between the lid 30 and tank 18. The arrows show the possible pathways of air from the toilet bowl 14, through the flush water holes 62, into the fluid channels 58, into the toilet flush valve 22, through the overflow pipe conduit 24, up the overflow pipe 26, through the stabilizer tube 140, through the blower 132, through the air filter 124, out through the gaps 164, and back to the atmosphere.

The water skirt 136 is configured such that when the tank 18 is full of water, the water covers a portion of the bottom of the water skirt 136 thus forming a sealed chamber within the water skirt 136. This sealed chamber is in fluid communication with the overflow pipe 26 and the inlet side blower fan 132. The blower fan 132 creates a slight negative pressure above the overflow pipe and, as previously discussed, air is drawn in from the bowl 14, up through the flush water holes 62, into the fluid channels 58, into the toilet flush valve 22, through the overflow pipe conduit 24, up the overflow pipe 30, through the stabilizer tube 140, through the blower 132, through the air filter 124, out through the gaps 164, and back to the atmosphere. The water level line 82 shows where the water level is when the tank 18 is full. During a flush, the water level drops below the water skirt 136, and there is no longer a negative pressure within the water skirt 136, because there is no longer a sealed chamber, due to the water level having lowered, and thus "unsealing" the chamber within the water skirt 136.

Given the differential pressure between the bowl area 14, at atmospheric pressure, and the space in the water skirt 136 chamber and the physical airway between them the foul vapors are effectively drawn from the bowl 14 to the supply side of the blower fan 132. From there the foul air is sent through the filter media 124, cleaned, and released back to the space above the water where a slight positive pressure, due to the output of the filter, pushes the cleaned air out through the gaps 164 between the tank 18 and lid 30 to the atmosphere. During a flush and until the water again rises to the water level line, and covers the bottom of the water skirt 136, the overflow pipe 26 is effectively open to the atmosphere and can function as a vent to allow the water to empty out of the bowl 14, after the flush valve has closed.

In other embodiments, rather than using a stabilizer tube 140, the odor removal unit 120 may be attached to a stand, with supporting legs, which is placed in the tank 18, and configured to hold the unit 120 at the proper height so that when the water level is at the water level line 82, a chamber is formed within the water skirt 136, thus allowing for air from the bowl 14 to be drawn up due to the negative pressure in the chamber created by the blower fan 132.

Figure 5:
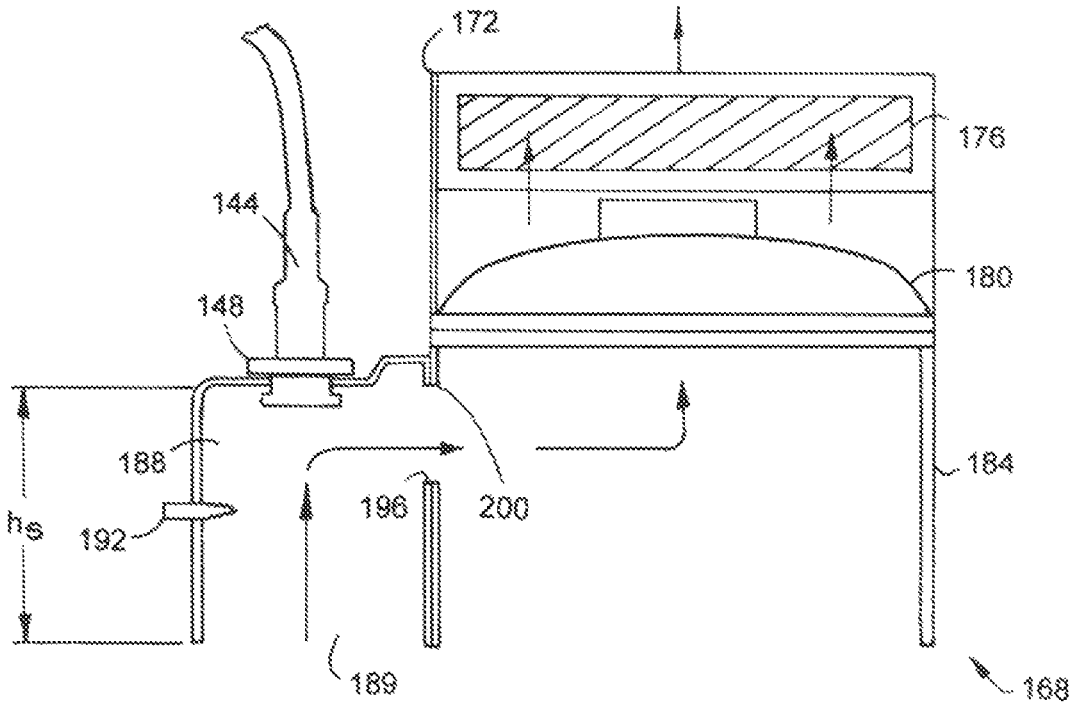
FIG. 5 is cross-sectional view of another embodiment of the disclosed bathroom odor removal apparatus.

FIG. 5 shows a cross-sectional view another embodiment of an odor removal unit 168. In this unit, a housing 172 encloses a filter 176 and a blower fan 180. The housing extends into a water skirt 184 which is open at the bottom. Removeably attached to the water skirt 184 is a standard stabilizer adaptor unit 188 that is configured to slide over an overflow pipe 26. The stabilizer adaptor unit is open on only one end, its outlet end 189. A locking screw 192 is configured to lock the stabilizer adaptor unit onto the overflow pipe 26. The stabilizer adaptor unit 188 has an opening 196 that is adjacent to an opening 200 in the water skirt 184. These openings allow air from the overflow pipe 26 to enter the standard stabilizer adaptor unit 188, exit the stabilizer adaptor unit 188 via the opening 196, and enter the water skirt 184 via the opening 200. The arrows indicate possible pathways that the air may take. When the water level is above the bottom of the standard stabilizer adaptor unit 188 and the water skirt 184, the water skirt 184 and standard stabilizer adaptor unit 188 forms a low pressure chamber that pulls air up from the overflow pipe, into the blower fan 180 and on into the filter 176 where it exits the odor removal unit 168.

Figure 6:
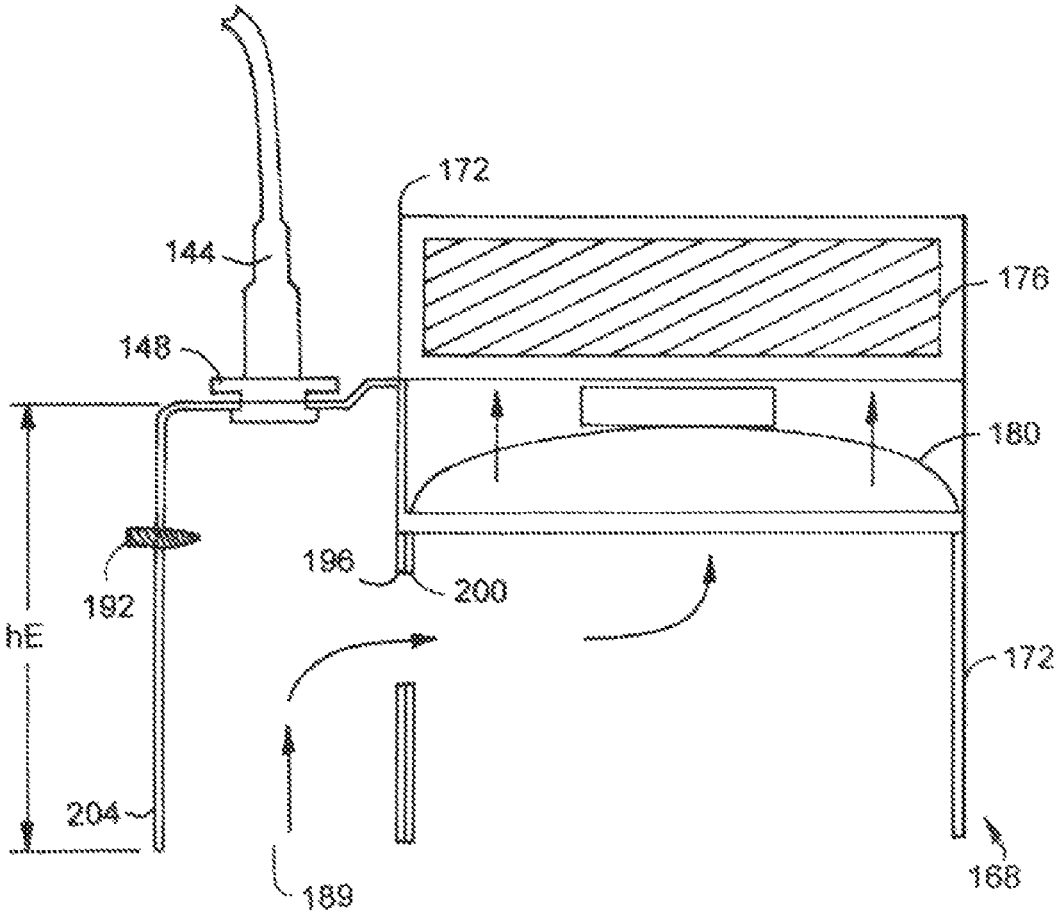
FIG. 6 is cross-sectional view of the disclosed bathroom odor removal apparatus from FIG. 5 with an extended stabilizer tube installed.

The stabilizer adaptor unit is designed as a separate unit, which attaches to the water skirt, primarily for the purpose of making the entire assembly very adaptable to a wide variety of installations. For instance, the overflow pipe, in any individual situation, may be found to be rotated about the flapper valve to any position that clears the flush handle rod. Although possible it is very difficult to change the position that the overflow pipe is found therefore it is desirable to leave the overflow pipe in the found position and adapt the air sanitizing unit attachment to accommodate it. As the overflow pipe is rotated, to different positions, the spatial relationships, within the tank can change such that the mounting requirements of the air sanitizing unit also change The standard stabilizer adaptor unit 188 has a height $H_s$. One additional reason the standard stabilizer adaptor unit 188 can be set on the outside of the water skirt 184 in this embodiment, is that sometimes the overflow pipe 26 extends too high above the water level line in the tank 18 when the tank is full. When the overflow pipe 26 extends too high, then the bottom of the water skirt 184 and standard stabilizer tube 188 are also above the water level line, and a chamber is not formed within the water skirt 184 and stabilizer adaptor unit 188. Therefore, in this embodiment, an extended stabilizer adaptor unit 204 may be used instead of the standard stabilizer adaptor unit 188. Referring to FIG. 6, an extended stabilizer adaptor unit 204 has replaced the standard stabilizer adaptor unit 188. The extended stabilizer adaptor unit 204 has a height $H_E$. The extended stabilizer adaptor unit 204 is configured to attach to an overflow pipe 26 that extends too high above the water level line, and still allow the bottoms of the extended stabilizer adaptor unit 204 and water skirt 184 to be below the water level line, thus forming a chamber within the stabilizer adaptor unit 204 and water skirt 184. This is because the extended stabilizer adaptor unit 204 is taller than the standard stabilizer adaptor unit 188, i.e. $H_E$ is greater than $H_s$.

Figure 7:
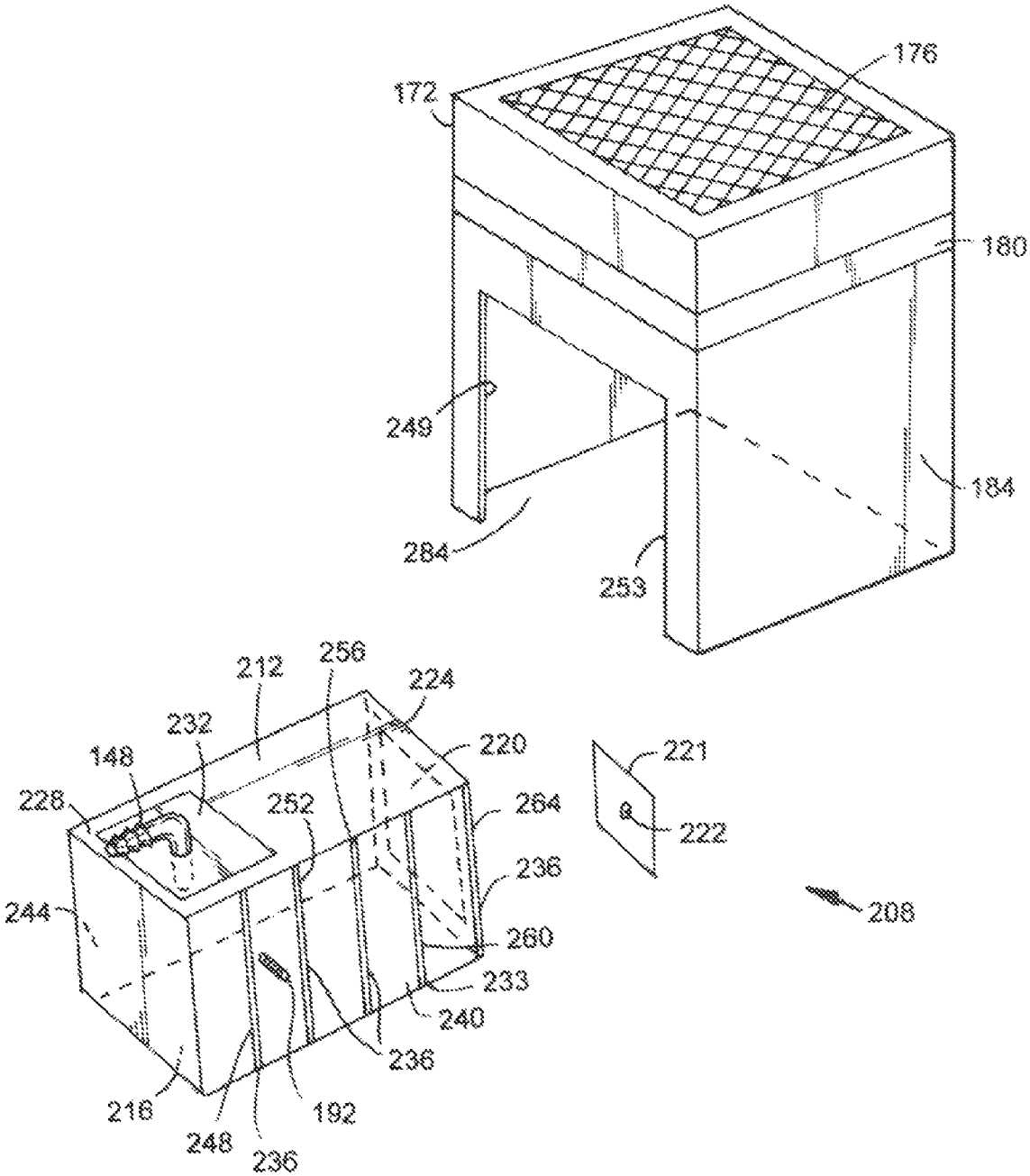
FIG. 7 is a perspective view of an extendible and retractable embodiment of the disclosed bathroom odor removal apparatus.

FIG. 7 shows a perspective view of another embodiment of an odor removal unit 208. In this unit, a housing 172 encloses a filter 176 and a blower fan 180. The housing 172 extends into a water skirt 184 which is open at the bottom. Removeably attached to the water skirt 184 is an adjustable stabilizer adaptor unit 212 that is configured to slide over an overflow pipe 26. The adjustable stabilizer adaptor unit 212 is open at its bottom 216 and has a rear opening 220 on a rear wall 224. The top wall 228 of the adjustable stabilizer adaptor unit 212 does not have an opening in this embodiment, however it does have a openable panel 232. The interior surface of the top wall 228 shall refer to the surface on the side of the top wall that faces the bottom 137 of the water skirt 184. The top surface of the top wall 228 shall refer to the side opposite of the interior surface. Similarly, the rear opening 220 is generally closed by a panel 221, that may be removed when used in an external installation of the adjustable stabilizer adaptor unit 212 on the water skirt 184. The panel 221 has a panel opening 222. A locking screw 192 is configured to lock the adjustable stabilizer adaptor unit 212 onto an overflow pipe 26. The water skirt 184 has a side opening 284 with a first opening edge 249 and second opening edge 253. A plurality of vertical grooves 236 are located on the first side wall 240, and on the second side wall 244 (the grooves 236 on the second side wall 244 are not visible in this view). The grooves are configured such that a pair of grooves (one on each of the first side wall 240 and second side wall 244) are able slide over the first opening edge 249 and second opening edge 253 of the water skirt 184. Each pair of grooves 236 will be referred to as a "set of grooves". In this embodiment, there are a first set 248 of grooves, second set 252 of grooves, third set 256 of grooves, a fourth set 260 of grooves, and a fifth set 264 of grooves. However, one of ordinary skill will understand that more and less than 5 sets of grooves 236 may be used with the adjustable stabilizer adaptor unit 212.

Depending on which pair of grooves 236 used to slide onto the first opening edge 248 and second opening edge 252, the adjustable stabilizer adaptor unit 212 can be adjustably extended out of the water skirt 184 or retracted into the water skirt 184. Attached to the openable panel 232 is an adapter 148 configured to couple to a refill tube 144. The adapter is configured to allow fluid communication between the refill tube and the overflow pipe 26 when the overflow pipe is inserted into the adjustable stabilizer adaptor unit 212.

Figure 8:
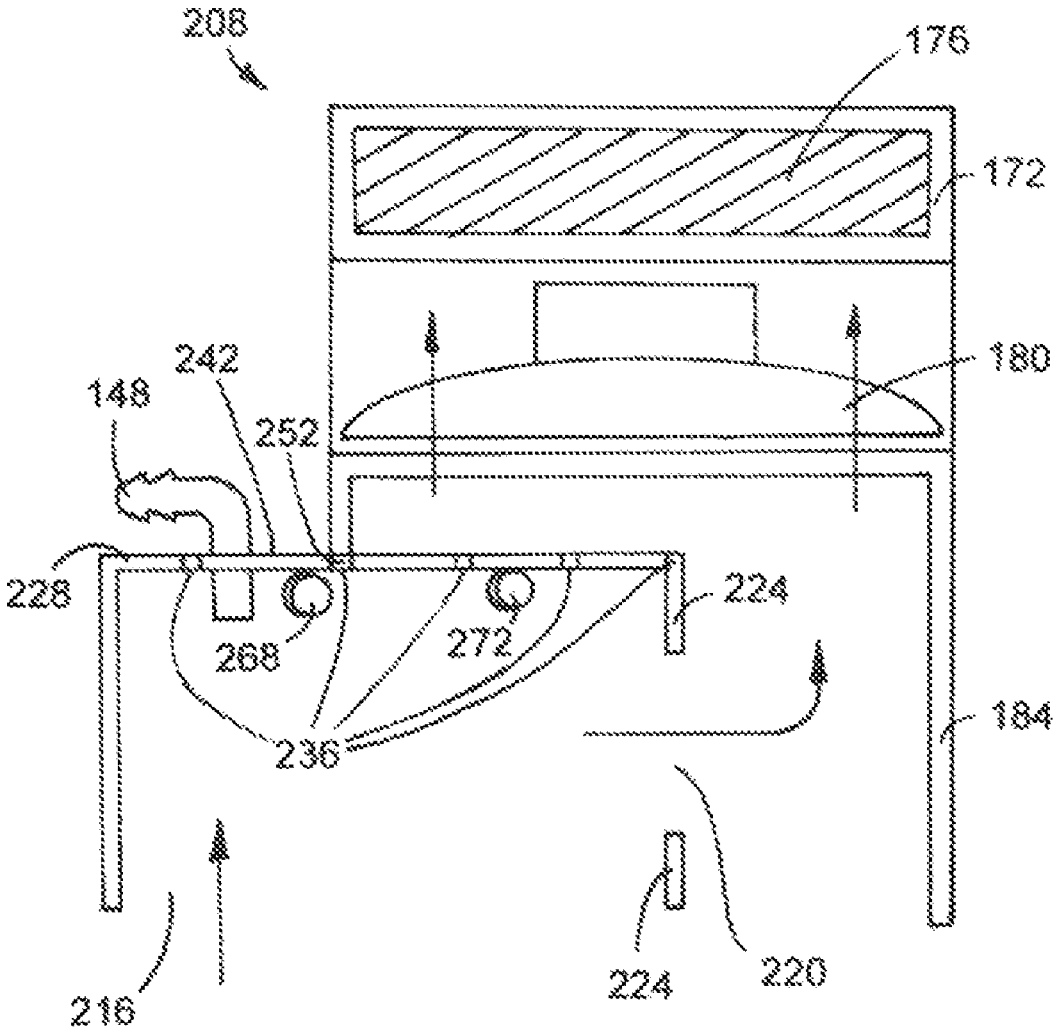
FIG. 8 is a cross-sectional view of the bathroom odor removal apparatus from FIG. 7.

FIG. 8 shows a cross-sectional view of the odor removal unit 208 from FIG. 7, with the adjustable stabilizer adaptor unit 212 installed upon a second set 252 of grooves 236. A first set of clips 268 and a second set of clips 272 are shown on the interior side of the top wall. These clips 268, 272 are to be used when the adjustable stabilizer adaptor unit is used in an internal installation configuration, as will be seen in FIG. 10. The arrows indicate possible pathways that the air may take. Also shown in this view are a first set of clips 268 and a second set of clips 272 attached to the interior surface of the top wall 228.

Figure 9:
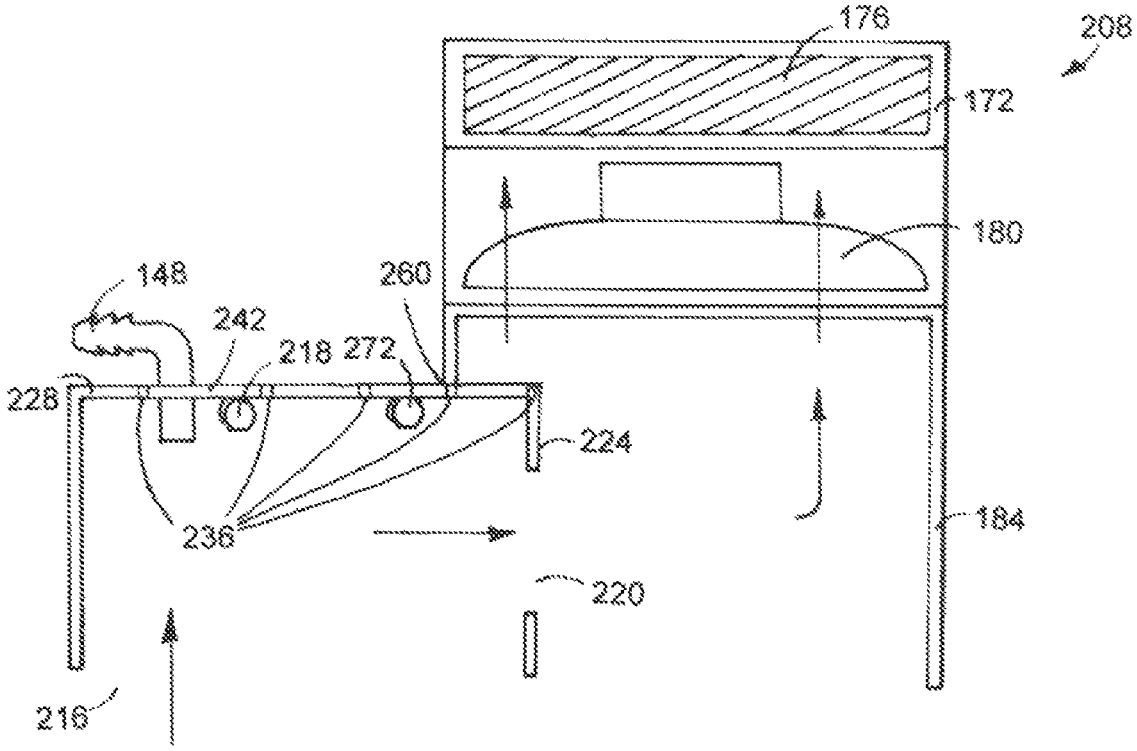
FIG. 9 is a cross-sectional view of the bathroom odor removal apparatus from FIG. 8 with the adjustable stabilizer adaptor unit extended.

FIG. 9 shows a cross-sectional view of the odor removal unit 208 from FIG. 7, with the adjustable stabilizer adaptor unit 212 installed upon a fourth set 260 of grooves 236. Thus, comparing the configuration shown in FIG. 9 with that shown in FIG. 8, one can see how the adjustable stabilizer adaptor unit 212 can be adjusted to extend further from the water skirt 184 (as shown in FIG. 9), or be retracted into the water skirt 184 (as shown in FIG. 8). The arrows indicate possible pathways that the air may take.

Figure 10:
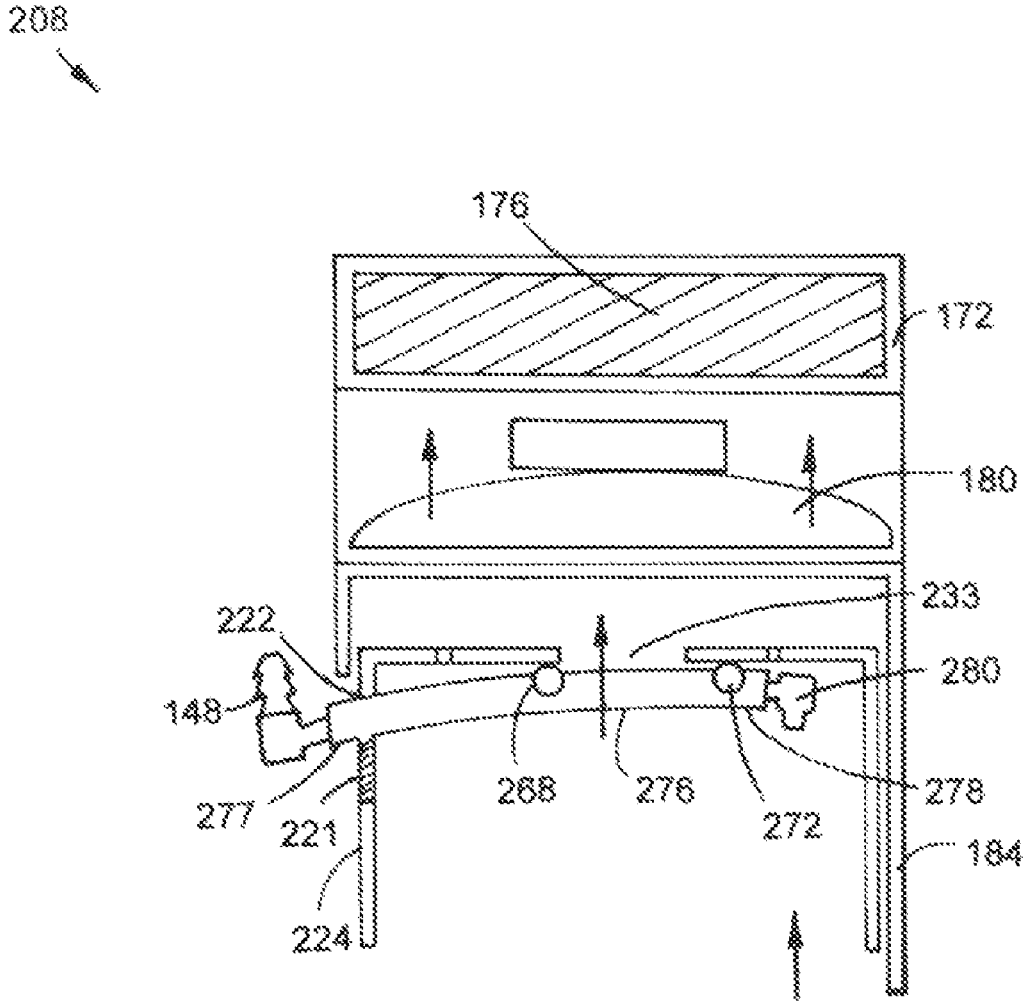
FIG. 10 is a cross-sectional view of the bathroom odor removal apparatus from FIG. 9 with the adjustable stabilizer adaptor unit installed in an internal mounting configuration.

FIG. 10 shows an internal installation of the adjustable stabilizer adaptor unit 212 into the odor removal unit 208. In this embodiment, the rear opening panel 221 is left on the rear wall 224. The adjustable stabilizer adaptor unit 212 has been turned around such that the rear wall 224 is adjacent to the water skirt first opening edge 249 and the water skirt second opening edge 253. In this configuration, the top wall opening panel 232 is removed, leaving a top wall opening 233. A conduit 276 passes through the opening 222 in the rear opening panel 221. The conduit 276 is held in place by the clips 268, 272. Attached at a first end 277 of the conduit 276, and located outside of the water skirt 184, is the adapter 148. Attached at a second end 278 of conduit 276, is a overflow pipe adapter 280. The overflow pipe adapter 280 is configured to direct fluid from the a refill tube 144 into an overflow pipe 26. The arrows indicate possible pathways that the air may take.

The embodiment shown with respect to FIGS. 7-10 illustrates that the adjustable stabilizer adaptor unit 212 makes the odor removal unit 208 very adaptable to the various situations that may be encountered when installing the device. The disclosed odor removal unit 208 has a plurality of mounting positions and also can be installed as an internal or an external mounting.

In still another embodiment, the disclosed odor removal unit may be used as a toilet "tank top unit". This may done when the physical constraints of the toilet tank interior make internal mounting impractical. The disclosed odor removal units are also effective in controlling cat box, laundry room, ashtray and other odors that emanate about a limited area. To get the best effect from this type of usage the disclosed odor removal unit may be placed in close proximity to the source of the offending odor. This device, when left to run in the open air is quite effective at freshening the air for a limited area around the device. This has been found to be true even for limited areas in larger rooms. For instance, near an ash tray, in a room or near a cat litter box in a large basement. The stabilizer adaptor unit opening may be aimed at the target odor for better effectiveness. Some alternate uses for the disclosed odor removal unit are: near an open cat litter box; on top of the vent on an enclosed cat litter box; next to an ash tray or over a small ash tray. near hampers, in laundry rooms; near dog beds and other smelly pet areas; on top of toilet tanks for toilets that cannot accommodate the device being installed internally; in a bathroom without an exhaust fan; used diaper storage; and anywhere that low volumes of often intense, localized odors exist.

The disclosed bathroom odor removal apparatus and system has many advantages. The apparatus has generally the same appearance as a standard toilet. The disclosed apparatus and system makes very little sound. The disclosed apparatus and system does not interfere with the normal flushing action. Adding the disclosed apparatus and system to an existing product line would be easy for an OEM. The disclosed invention can be easily adapted to most existing toilets, without any modification and can be adapted to many other existing toilets with only minor modifications. The disclosed system and apparatus can be fitted to existing toilets on a fast turnaround basis where the original toilet top is shipped for modification and installation of the hardware then returned. Shipping kits with temporary tank lids could be marketed to facilitate this. If the filter media is an 11 ounce charge of activated carbon media, it should last up to six months, depending on the intensity and frequency it is subjected to the various odor producing vapors, before needing replacement. Replacing the filter is simple, easy, inexpensive and without encountering toilet bowl contaminants. There are no ugly hardware items in the area of the bowl to become contaminated and have to be cleaned. In some embodiments, there are no batteries to replace. There is no need to install ductwork or exhaust fans in the walls and ceilings. Operating the disclosed apparatus and system helps to dry the bowl and remove residual contaminated air and also inhibits mold and bacteria. This adds to improved air freshness. The disclosed system uses simple, reliable components to insure a long service life and provides for ease of repair. The disclosed apparatus and system does not use dangerous chemicals. The disclosed system and apparatus does not require dangerous high voltages. The disclosed system and apparatus requires 12 volts or less at a current in the less than 200 ma range, thus making the disclosed apparatus and system intrinsically safe, even if a live connector plug were to fall into the tank water. The cost of electricity for the system and apparatus is about $2.00 per year based on $0.10 per kilowatt hour.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A bathroom odor removal apparatus comprising:

a housing with a first end and a second end;

a filter located on a first end of the housing;

a blower fan located in the housing adjacent to the filter;

a water skirt, with a side opening, the side opening with a first opening edge and second opening edge, and the water skirt with an open bottom, the water skirt extending from the second end of the housing;

an adjustable stabilizer adaptor unit removeably attachable to the first opening edge and second opening edge, the adjustable stabilizer adapter unit having a top wall, a rear wall, first a side wall, and a second side wall, a removable rear panel located on the rear wall;

a removable top panel located on the top wall;

at least one clip located on an interior surface of the top wall;

a removable conduit configured to attach to the at least one clip;

an adapter configured to removeably couple to a refill tube, to a first end of the removable conduit; and to the top panel;

an overflow pipe adapter configured to attach to one end of the conduit;

a plurality of pairs of grooves, with one groove from each pair located generally on the first side wall, and the second groove from each pair located generally on the second side wall; and wherein the adjustable stabilizer adaptor unit can be attached to the water skirt via any pair of grooves.

2. The bathroom odor removal apparatus of claim 1 further comprising:

a power supply in communication with the blower fan.

* * * * *